US008671470B2

(12) United States Patent
Miller et al.

(10) Patent No.: US 8,671,470 B2
(45) Date of Patent: Mar. 18, 2014

(54) WAX-LESS TOILET GASKET

(75) Inventors: Jody D. Miller, Indianapolis, IN (US); Robert M. Grimmett, Indianapolis, IN (US)

(73) Assignee: Sani-Seal LLC, Indianapolis, IN (US)

( * ) Notice: Subject to any disclaimer, the term of this patent is extended or adjusted under 35 U.S.C. 154(b) by 0 days.

(21) Appl. No.: 13/013,954

(22) Filed: Jan. 26, 2011

(65) Prior Publication Data

US 2011/0185487 A1 Aug. 4, 2011

Related U.S. Application Data

(63) Continuation-in-part of application No. 12/697,796, filed on Feb. 1, 2010, now abandoned.

(51) Int. Cl.
*E03D 11/00* (2006.01)

(52) U.S. Cl.
USPC ..... 4/252.1

(58) Field of Classification Search
USPC ..... 4/300, 504, 252.1–252.6, 622, 559, 4/300.3, 605, 630–636, 619; 272/586, 272/609; 285/56, 24; 134/166 C
See application file for complete search history.

(56) References Cited

U.S. PATENT DOCUMENTS 3,821,820 A * 7/1974 Thompson ..... 4/252.6
4,482,161 A * 11/1984 Izzi, Sr. ..... 277/606
4,715,609 A * 12/1987 Mino et al. ..... 277/608
5,114,980 A * 5/1992 Lii et al. ..... 521/51
5,873,136 A * 2/1999 Geeham ..... 4/434
5,930,845 A * 8/1999 Geeham ..... 4/252.4
5,946,747 A * 9/1999 Geeham ..... 4/684
5,950,250 A * 9/1999 Geeham ..... 4/252.6
6,070,910 A * 6/2000 Hodges ..... 285/2
6,085,362 A * 7/2000 Huber ..... 4/252.4
6,085,363 A * 7/2000 Huber ..... 4/252.4
6,691,331 B2 * 2/2004 Gallacher et al. ..... 4/252.5
6,694,537 B2 * 2/2004 Telles ..... 4/252.6
6,883,187 B2 * 4/2005 Cornwall ..... 4/252.5
7,165,275 B2 * 1/2007 Clark ..... 4/252.1
7,617,548 B2 * 11/2009 Johnston ..... 4/631
7,814,580 B2 * 10/2010 Coronado et al. ..... 4/252.6
8,060,956 B2 * 11/2011 DeGooyer ..... 4/613
8,091,156 B1 * 1/2012 Lordahl ..... 4/252.6
8,112,827 B2 * 2/2012 DeGooyer et al. ..... 4/288
8,141,181 B2 * 3/2012 Faulstich ..... 4/575.1
2001/0023505 A1 * 9/2001 Atkins ..... 4/252.6
2006/0225195 A1 * 10/2006 Scholer ..... 4/300
2007/0151010 A1 * 7/2007 Ellerbe ..... 4/300.3
2010/0017957 A1 * 1/2010 Johnston ..... 4/631
2011/0185487 A1 * 8/2011 Miller et al. ..... 4/252.5

* cited by examiner

*Primary Examiner* — Lori Baker
(74) *Attorney, Agent, or Firm* — Bruce J. Bowman

(57) ABSTRACT

A wax-less toilet gasket is provided that is formed of an open cell foam having a hydrophobic skin, layer, coating or covering. To this end, the toilet gasket may be formed of a self-skinning polyurethane, a polyurethane with an in-mold coating, or a polyurethane with a waterproof agent. The toilet gasket is characterized by a body with a ring shaped upper portion and a truncated conical extension integrally extending downwardly therefrom. In use, fastening bolts that project through the toilet flange attached to the floor conduit then extend through the ring shaped configuration and attach to the toilet base.

5 Claims, 4 Drawing Sheets

WAX-LESS TOILET GASKET

CROSS-REFERENCE TO RELATED APPLICATIONS

This patent application is a continuation-in-part of U.S. patent application Ser. No. 12/697,796 filed Feb. 1, 2010, now abandoned entitled "Wax-Less, Integral Skin Toilet Gasket", the entire contents of which is specifically incorporated herein by reference.

BACKGROUND OF THE INVENTION

1. Field of the Invention

The present invention relates generally to the field of gaskets positioned between a toilet base and a toilet flange.

2. Description of the Prior Art

A gasket is positioned between the outlet base of a toilet and the upwardly facing toilet flange provided on the floor drain. The object of the gasket is to provide a water and gas seal; however, many of the prior art gaskets develop leaks. Frequently a gasket is stored in a high temperature environment prior to installation of the gasket thereby causing the gasket to degrade. In the event the gasket is subjected to high temperatures or if the toilet is rocked back and forth then leaks may develop.

The standard gasket is produced from pliable wax. If the toilet has to be removed for repair, the plumber must manually remove and scrape off the wax gasket prior to installation of a new gasket. Further, the gasket is difficult to observe when the toilet is positioned upon the floor drain providing for the possibility that the gasket will not be aligned with respect to the toilet base and the flange on the floor drain. What is needed is a gasket that exhibits flexibility while maintaining a seal even if the toilet is rocked relative to the floor and which also minimizes degradation of the gasket in the event the gasket is stored or used in a relatively high temperature environment. Further, it is desirable to have a gasket that is repositionable and reusable in the event the toilet must be removed from the floor and reinstalled.

Currently there are a number of solutions for a toilet flange gasket. Some of these solutions use a wax ring, but these solutions fail to meet the need of the industry because the wax is not resilient. Other solutions attempt to use open cell foam encased in wax. This is similarly unable to meet the industry needs. Still other solutions attempt to use a PVC extension which is glued to the bottom of the toilet around the horn. While this solution is wax-less, there are multiple flange outlet sizes that need to be known to match the proper gasket to the flange, also it will not stick well to the bottom of a toilet that has been previously positioned on a wax ring. Therefore, its suitability is primarily limited to use on new toilet installation and not easily used in repositioning an existing toilet.

A number of U.S. patents have been granted on toilet gaskets. The U.S. Pat. No. 6,694,537 issued to Telles discloses a polyethylene foam gasket having resilience and the ability to recover substantially its original shape and thickness after compression loading. The U.S. Pat. No. 6,691,331 issued to Telles discloses an elastomeric gasket located between the toilet bowl and the floor. The U.S. Pat. No. 3,821,820 issued to Thompson discloses a toilet gasket having a ring of wax-like material. The U.S. Pat. No. 4,482,161 issued to Izzi, discloses a toilet gasket designed to replace the conventionally used wax sealing rings and having a main body of rubber like material, such as polyvinyl chloride. The U.S. Patent Publication 2006/0225195 discloses an anti-microbial package for use in toilet wax gaskets. The U.S. Pat. No. 5,114,980 issued to Lii et al. discloses a polyurethane integral skin foam.

The present invention is superior when compared to other known devices and solutions because the present invention provides a suitable seal without the use of wax. Furthermore, the present invention is repositionable, can be used over a wide temperature range, provides a seal on various flange configurations relative to floor grade and is antimicrobial. In addition, the present invention can be stacked to provide a seal when the gap is too large for one gasket. For additional protection, the gaskets can be siliconed together or coated with plumbers grease. The present invention is unique in that it is structurally different from other known devices and solutions.

The present invention is unique due to being made of an open cell foam having a hydrophobic skin, layer, covering or coating. Other features unique to the present invention are presented and discussed below.

SUMMARY OF THE INVENTION

A wax-less, repositionable toilet gasket provides a liquid and gas seal between a toilet base and a toilet flange that is mountable on a drain conduit to which the toilet base is mountable. The toilet gasket has a main body of an open cell foam construction that extends throughout the main body with a hydrophobic skin, layer, covering or coating thereon (i.e., layer). The body has a ring shaped upper portion for acting as a seal between a toilet base and a toilet flange on a drain conduit, and a truncated conical extension integral with the ring shape. In use the truncated conical extension is positioned into the drain conduit to direct liquid flow. The present toilet gasket maintains a seal despite varying loads thereon by the toilet base and despite repositioning thereof.

The open cell foam is preferably, but not necessarily, a polyurethane foam. The hydrophobic layer of the body may be a skin as a result of a self-skinning/integral skin polyurethane foam, an in-mold coating, or a waterproof agent. The in-mold coating and/or the waterproof agent may additionally be added to the integral skin polyurethane foam.

It is an object of the present invention to provide a new and improved gasket for positioning between a toilet base and flange of a floor drain.

A further object of the present invention is to provide a wax-less repositionable toilet gasket.

It is an object of the present invention to provide a wax-less repositionable toilet gasket having a main body with a hydrophobic layer.

In addition, it is an object of the present invention to provide a wax-less toilet gasket having a main body with an outer skin insuring structural integrity.

Related objects and advantages of the present invention will be apparent from the following description.

BRIEF DESCRIPTION OF THE DRAWINGS

The above mentioned and other features, advantages and objects of this invention, and the manner of attaining them, will become apparent and the invention itself will be better understood by reference to the following description of embodiments of the invention taken in conjunction with the accompanying drawings, wherein.

Like reference numerals indicate the same or similar parts throughout the several figures.

DESCRIPTION OF THE PREFERRED EMBODIMENT

Figure 1:
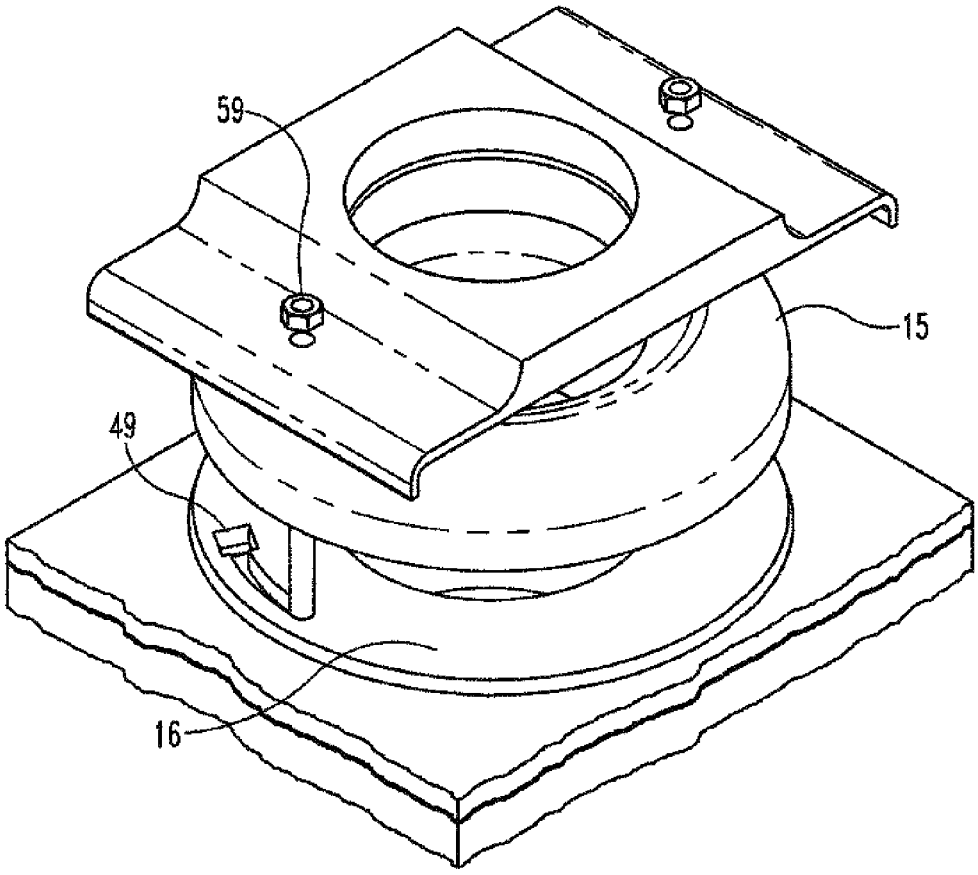
FIG. 1 is an exploded view of a toilet gasket according to the principles of the present invention positioned between a toilet flange attached to a floor drain and a toilet outlet base.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to the drawings, there is shown a wax-less repositionable toilet flange gasket 15 positioned between a toilet flange 16 attached to the floor drain conduit 17 and the toilet base 18, in turn, attached to the toilet.

Gasket 15 includes a main body or body 19 of an open cell foam and preferably, but not necessarily, a polyurethane foam construction which extends throughout the main body. Herein, the use of polyurethane foam will be deemed to encompass all suitable open cell foams for the gasket. Main body 19 includes a ring shaped upper portion 20 integrally attached to or formed with a truncated conical extension 21. The truncated conical extension 21 is extendable into the toilet flange 16, which in turn, extends into and fixedly attaches to the drain conduit 17. The truncated conical extension 21 directs liquid flow into the toilet flange 16 and thus the conduit 17.

Ring shaped upper portion 20 includes an outer top curved surface 22 extending downwardly to a vertical surface 23 with both surfaces 22 and 23 being continuous and extending around the longitudinal center axis 24. Upper portion 20 forms a hollow interior 25 receiving the fluid from the downwardly extending extension 26 of toilet base 18. Base extension 26 fits into hollow interior 25 that is formed by a top inner curved surface 27 that extends downwardly to a planar surface 29 extending through the length of extension 21. Planar surface 29 and curved surface 27 extend continuously around axis 24. The junction of the outer curved surface 22 and the inner curved surface 27 forms an upwardly facing top surface 28 that contacts the downwardly facing flat surface 30 of flange 31 of toilet base 18 effecting a liquid and gas tight seal between toilet base 18 and gasket 15. The gasket, toilet base and toilet flange are shown in separated positions in the drawings in order to more clearly show the various components; however, it is to be understood that in use, base 18 is in contact with gasket 15 which, in turn, is in contact with toilet flange 16.

A downwardly facing flat or planar surface 33 extends continuously around extension 21 being joined at its outer edge portion to surface 23 and on its inner edge portion to extension 21. Extension 21 is a truncated, downwardly extending cone forming a hollow passage through which the liquid and gas flow. Extension 21 has an outside continuous surface 34 parallel to the inner continuous flat surface 29. The outside diameter of the extension formed by surface 34 along with the inside diameter of the extension formed by surface 29 both decrease in diameter as the extension extends downwardly. Surface 29 is blended into inner curved surface 27 whereas the outside continuous surface 34 is at an oblique angle to planar surface 33.

Building floor 40 may include a bottom wood floor frame 41 having positioned thereon a finished floor 42 of suitable material, such as tile. Toilet flange 16 has a continuous ring shaped flange 43 integrally joined to a cylindrical pipe extension 44, in turn, extending into drain conduit 17. Extension 44 is sealed to conduit 17 by any number of conventional means. Floor 40 includes a hole through which extension 44 extends with flange 43 then being positioned atop floor 40 or in some cases being recessed into the floor.

A pair of conventional bolts 46 and 47 have heads 48 extended into holes 49 provided 180 degrees apart on flange 16 with one such hole 49 being shown in FIG. 1. A pair of accurate shaped slots extend from each hole 49 with each slot having a counter bore or enlarged lower opening 50 enabling the head 48 of each bolt to be extended through openings 49 while the shank of the bolt is extended upwardly. The shanks may be moved along the lengths of the accurate slots to distance the bolt head apart from hole 49 preventing accidental disengagement of the bolt from the flange. Each bolt shank then extends through bolt holes 52 and 53 located 180 degrees apart on the upper portion of the gasket. Holes 52 and 53 extend through the outer curved surface 22 and the downwardly facing planar surface 33 of the ring shaped configuration. Outer curved surface 22 is positioned radially outward of extension 21.

Once the gasket 15 is installed to the toilet flange by the extending extension 21 into extension 44 and with the bolt shanks passing through holes 52 and 53, toilet base 18 is mounted to the bolts. Toilet base 18 includes a pair of bolt holes 56 and 57 located 180 degrees apart with the bolt shanks then extending above flange 31 whereat conventional hexagonally shaped nuts 59 (FIG. 1) are threadedly mounted to the bolt shanks thereby forcing toilet base 31 onto gasket 15 and, in turn, the gasket onto toilet flange 16 compressing the gasket and providing the liquid and gas seal between the toilet and conduit 17. Planar surface 33 contacts the upwardly facing surface of flange 43 affecting a liquid and gas seal between the gasket and the toilet flange 16.

Figure 2:
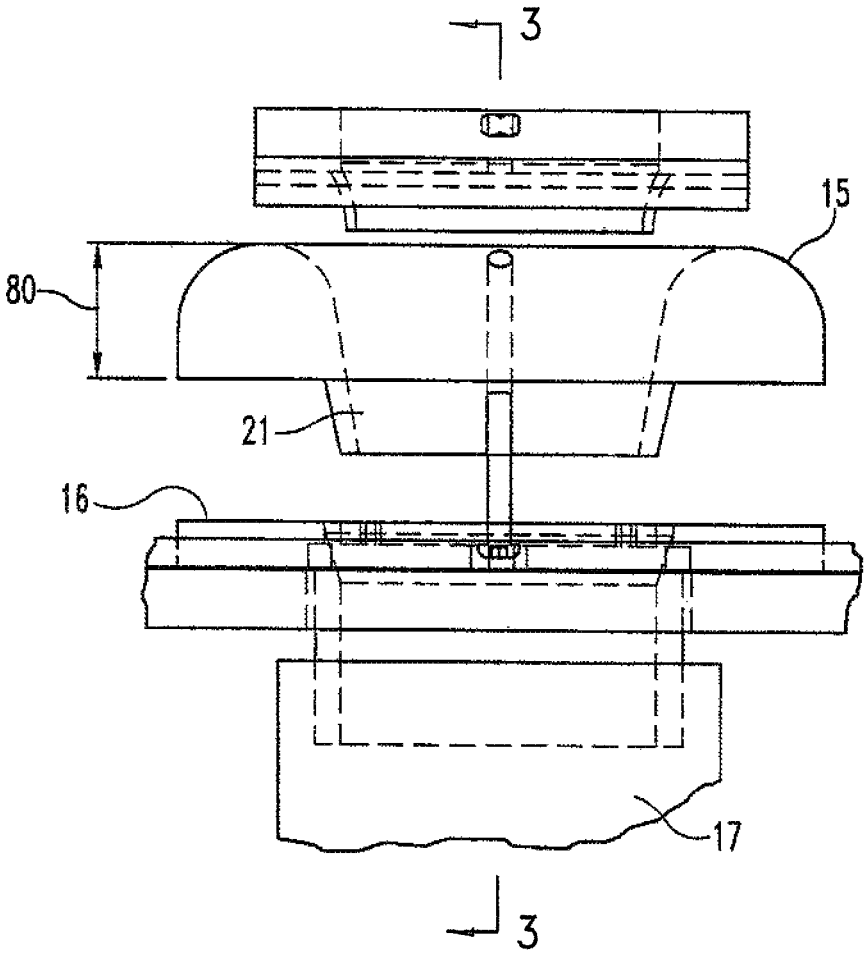
FIG. 2 is a side view of the combination shown in FIG. 1.
Figure 4:
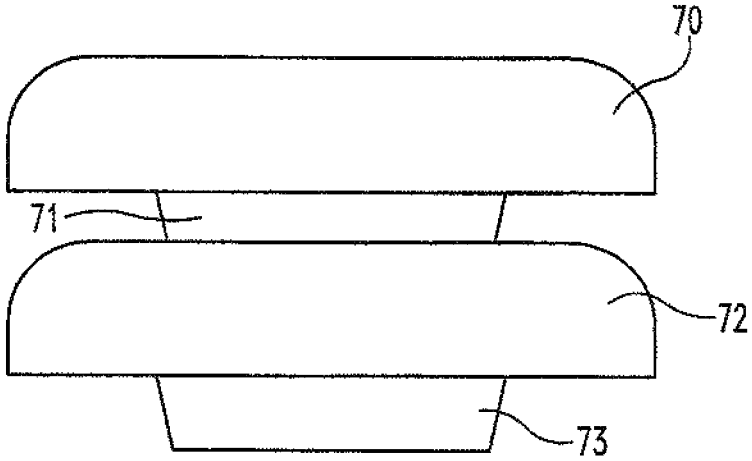
FIG. 4 is a side view of a pair of identical toilet gaskets 70 and 72 stacked together.

The truncated conical shaped extension 21 of gasket 15 is particularly useful in allowing gaskets to be stacked together. For example, top gasket 70 (FIG. 4) includes an extension 71 extending down through the ring shaped upper portion and into extension 73 of lower gasket 72. In the event the distance between toilet base 18 and toilet flange 16 is greater than the height 80 (FIG. 2), then a pair of gaskets 70 and 72 (FIG. 4) identical to gasket 15 may be stacked together. In such a case, the top surface 28 seals against toilet base 18 whereas the bottom planar surface 33 of top gasket 70 seals against the top surface 28 of bottom gasket 72 and the bottom planar surface 33 of bottom gasket 72 seals against toilet flange 16 in a manner identical to that described for gasket 15.

Figure 3:
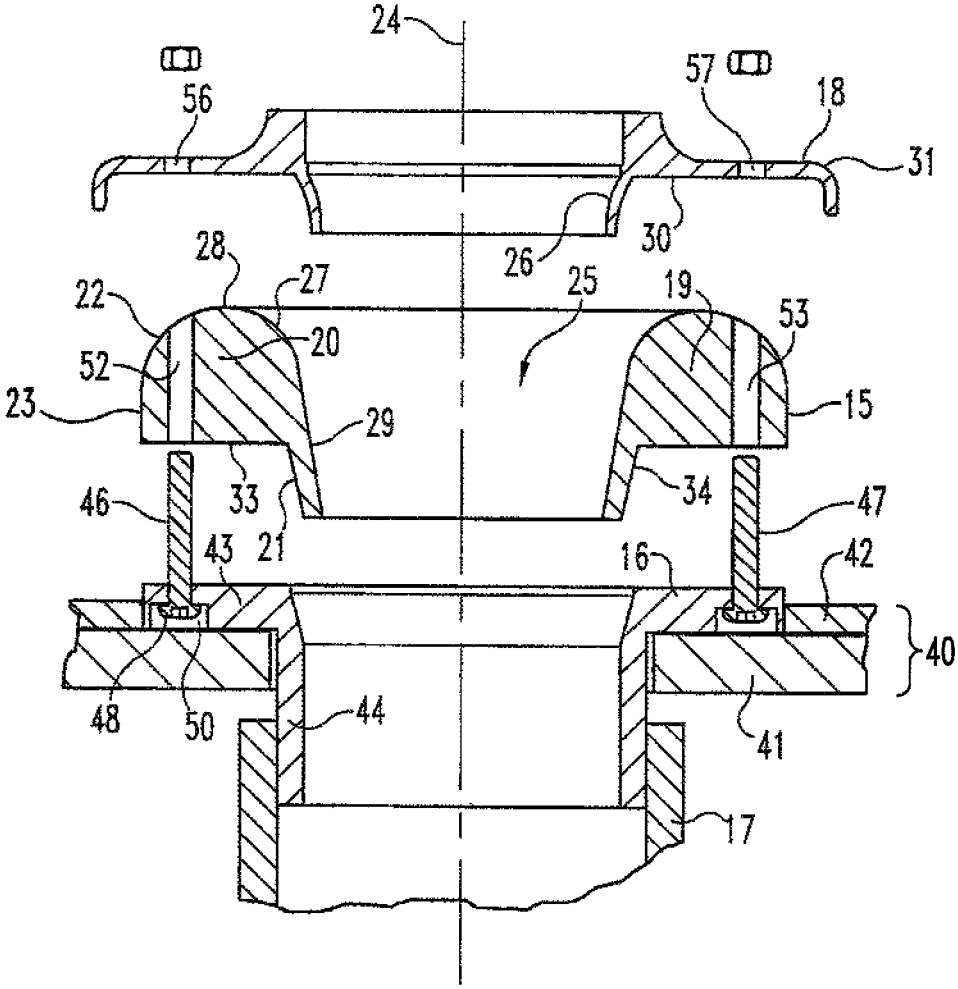
FIG. 3 is a cross-sectional view taken along the line 3-3 of FIG. 2 and viewed in the direction of the arrows.

The combination shown in the drawing consisting of the toilet base, drain conduit, building floor and gasket is particularly advantageous to accommodate variations and positioning of the flange 43 of toilet flange 16. That is, flange 43 may be positioned completely on top of the upper floor layer 42 or may be recessed as shown in FIG. 3 with the top surface of the toilet flange 16 being located slightly above the top surface of floor layer 42. Likewise, the top surface of flange 43 may be positioned beneath the top surface of floor layer 42 while still allowing the gasket to ensure a tight seal between the toilet base and toilet flange. This is true since the thickness of the ring shaped main body is sufficient to allow for variations in the positioning of toilet flange 16. In one embodiment, the thickness 80 (FIG. 2) has a thickness of at least one inch to accommodate variations and positioning of the toilet base relative to the upper surface of floor layer 42. By ensuring that dimension 80 is at least one inch between the top surface 28 and planar surface 33, the seal is accomplished with toilet flange 43 regardless of variations and positioning of the toilet flange 43 relative to the building floor 42 even through flange 43 is above or below the top surface of floor layer 42 providing the distance between bottom surface 30 of toilet base 18 and toilet flange 16 is not greater than one inch.

Gasket 15 is composed throughout of an open cell foam that is preferably, but not necessarily, a polyurethane foam. The gasket 15 has a hydrophobic skin, layer, covering or coating thereon (i.e., "layer"). The hydrophobic layer can constitute: 1) a skin from a self-skinning or integral polyurethane foam; 2) an in-mold coating; or 3) a waterproof agent. The polyurethane foam constituting the body 19 of the gasket 15 may be formed such that the resulting gasket is of a particular density. Particularly, the density of the foam and thus the gasket depends on the amount of polyurethane product in the mold during the mold process. The more polyurethane product that is used during the mold process, the greater the density of the gasket. The density of the polyurethane foam determines the amount of compression that the gasket can withstand while providing sufficient deflection to maintain a seal. As examples, one density of foam is such that compression down to one inch (1") provides sufficient deflection to maintain a seal, while another density of foam is such that compression down to one quarter inch (¼") provides sufficient deflection to maintain a seal.

The self skinning (or integral skin) polyurethane foam is flexible on the inside but tough on the outside. It has been used for athletic equipment and office seating applications. Such a product is available from Renosol of Saline, Minn. 48176. The material is also available from Jones & Vining, Inc. of Brockton, Mass. The polyurethane may be composed of the reaction product of a polyether polyol blend and an isocyanate. The polyol blend consists of a combination of polyether polyols (polyhydroxyl or polyamine compounds), surfactants, chain extenders, catalysts and any single or combination of physical and/or chemical blowing agents. The isocyanate may be either an MDI (diphenylethane diisocanate) or TDI (toluene diisocynate) or any combination thereof. The molded density of the product skin should be between 0.04 and 0.40 gm/cc. The product will perform over a temperature range of 0 to 200 degrees Fahrenheit. One integral skin foam is available under the name Poly 900 IS/Bayflex 976 A Iso from BayOne Urethane Systems LLC, St. Louis Mo. with parts typically molded to a density of 14-20 pcf. The polyurethane integral foam may be polyether based having BHT (butylated hydroxyl-toluene) providing an anti-microbial construction for the gasket.

An in-mold coating may constitute the hydrophobic layer of the polyurethane foam gasket 15. Such an in-mold coating would be applied during the molding process before application of the polyurethane. A release agent would preferably, but not necessarily, be applied to the mold before the in-mold coating. The in-mold coating may also be applied to the integral skin polyurethane foam gasket.

A waterproof agent may constitute the hydrophobic layer of the polyurethane foam gasket 15. The waterproof agent preferably, but not necessarily, comprises polychloroprene. However, other waterproof agents may be used such as PVC and vinyl. The waterproof agent may also be applied as a waterproof layer over the integral skin polyurethane foam gasket. The polychloroprene is applied out-of-mold, such as by dipping, once the gasket 15 is formed as described above.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, plumbers grease may be applied to the top surface of the gasket main body 19 and/or the bottom surface 33 of the gasket main body to achieve a superior seal.

What is claimed is:

1. A toilet gasket providing a liquid and gas seal between a lower surface of a toilet base and an upper surface of a toilet flange provided on a drain conduit to which the toilet base is mountable and through which liquid and gas waste flows, the toilet gasket comprising:

a repositionable, ring-shaped body having a planar lower surface for contacting the upper surface of the toilet flange and an uninterrupted arcuate upper surface for contacting the lower surface of the toilet base, the repositionable, ring-shaped body of a flexible open-cell foam with a high yield for compression of a distance between the lower surface of the toilet base and the upper surface of the toilet flange and deflection of the distance between the lower surface of the toilet base and the upper surface of the toilet flange to maintain a seal against liquid and gas egress between the lower surface of the toilet base and the upper surface of the toilet flange while resiliently attempting to return to its original shape to accept movement between the body, the toilet base and the toilet flange, the open-cell foam body comprising a combination of polyether polyols, isocyanates, surfactants, chain extenders, catalysts and any single one of a combination of physical and/or chemical blowing agents and wherein BHT is present in the polyether polyol providing an anti-microbial construction; and a layer on an entire outer surface of the repositionable, ring-shaped body having a molded density between 0.04 and 0.40 gm/cc that is impermeable to liquid and gas waste and able to accept sealants bonded to the surface of all elements without compromising sealing.

2. The toilet gasket of claim 1, wherein the repositionable, ring-shaped body includes first and second holes each extending through the repositionable, ring-shaped body from the upper surface to the lower surface thereof and configured to receive a bolt securing the toilet base and toilet flange together with the repositionable, ring-shaped body therebetween.

3. The toilet gasket of claim 1, wherein the repositionable, ring-shaped body further includes a truncated cone extending from the lower surface of the repositionable, ring-shaped body and defining a hollow forming a liquid and gas passage and having an outside continuous surface of an outside diameter and an inside continuous surface of an inside diameter both of which decrease in diameter as the truncated cone projects downwardly, the inside continuous surface blending with the arcuate upper surface of the repositionable, ring-shaped body while the outside continuous surface joins with the lower planar surface of the repositionable, ring-shaped body at an oblique angle allowing for stacking of a second toilet gasket having the same limitations of this claim thereon wherein the truncated cone fits down into a truncated cone of the second toilet gasket such that the truncated cone keeps the toilet gaskets in place allowing them to compress in their own footprint.

4. The toilet gasket of claim 1, wherein the flexible open-cell foam core of the body allows the toilet gasket to function in hot and cold environments.

5. The toilet gasket of claim 1, wherein the layer comprises a polychloroprene, vinyl, PVC or any combination thereof.

* * * * *